US011485611B2

(12) United States Patent
Kodeck et al.

(10) Patent No.: US 11,485,611 B2
(45) Date of Patent: Nov. 1, 2022

(54) ELEVATOR TENSION MEMBER WITH A HARD THERMOPLASTIC POLYURETHANE ELASTOMER JACKET

(71) Applicant: BEKAERT ADVANCED CORDS AALTER NV, Aalter (BE)

(72) Inventors: Valérie Kodeck, Denderleeuw (BE); Vincent Vermeersch, Deinze (BE)

(73) Assignee: BEKAERT ADVANCED CORDS AALTER NV, Aalter (BE)

( * ) Notice: Subject to any disclaimer, the term of this patent is extended or adjusted under 35 U.S.C. 154(b) by 949 days.

(21) Appl. No.: 16/316,175

(22) PCT Filed: Jul. 6, 2017

(86) PCT No.: PCT/EP2017/066955

§ 371 (c)(1),
(2) Date: Jan. 8, 2019

(87) PCT Pub. No.: WO2018/015173

PCT Pub. Date: Jan. 25, 2018

(65) Prior Publication Data

US 2021/0284501 A1 Sep. 16, 2021

(30) Foreign Application Priority Data

Jul. 19, 2016 (EP) ..... 16180131

(51) Int. Cl.
*B66B 7/06* (2006.01)
*D07B 5/00* (2006.01)
(Continued)

(52) U.S. Cl.
CPC ..... *B66B 7/06* (2013.01); *D07B 1/162* (2013.01); *D07B 5/006* (2015.07); *B66B 7/062* (2013.01);
(Continued)

(58) Field of Classification Search
CPC ..... B66B 7/06; B66B 7/062; D07B 5/006; D07B 1/162; D07B 1/22;
(Continued)

(56) References Cited

U.S. PATENT DOCUMENTS 3,634,607 A * 1/1972 Coleman ..... H01B 7/14 174/113 R
4,344,278 A * 8/1982 Jamison ..... D07B 7/12 57/232
(Continued)

FOREIGN PATENT DOCUMENTS

EP 2 508 459 9/2015
JP 2011-006519 1/2011
(Continued)

OTHER PUBLICATIONS

Chen et al., "Glass Transition Behaviors of a Polyurethane Hard Segment based on 4,4'—Diisocyanatodiphenylmethane and 1,4-Butanediol and the Calculation of Microdomain Composition", Macromolecules, 1997, vol. 30, pp. 5068-5074.
(Continued)

*Primary Examiner* — Michael A Riegelman
(74) *Attorney, Agent, or Firm* — Wenderoth, Lind & Ponack, L.L.P.

(57) ABSTRACT

An elevator tension member is presented that has one or more steel cords as strength members that are encased in a jacket of thermoplastic polyurethane elastomer. The thermoplastic polyurethane elastomer is selected on the basis of its thermal properties in that the glass transition temperature of the hard phase (Tg HS) is above 90° C. In preferential embodiments that thermoplastic polyurethane elastomer has a crystallisation temperature (Tg) that is at least 20° C. higher than Tg HS. In other preferential embodiments the sum of Tg HS and Tc is higher than 200° C. Such thermoplastic polyurethane elastomers exhibit an unexpected
(Continued)

increase in useful lifetime when compared to conventionally used polyurethanes. Moreover the invention provides a simple method to select an appropriate thermoplastic polyurethane elastomer.

14 Claims, 3 Drawing Sheets

(51) Int. Cl.
*D07B 1/16* (2006.01)
*D07B 1/22* (2006.01)

(52) U.S. Cl.
CPC ..... *D07B 1/22* (2013.01); *D07B 2201/2087* (2013.01); *D07B 2201/2092* (2013.01); *D07B 2205/2064* (2013.01); *D07B 2501/2007* (2013.01)

(58) Field of Classification Search
CPC .... D07B 2201/2087; D07B 2201/2092; D07B 2205/2064; D07B 2501/2007
See application file for complete search history.

(56) References Cited

U.S. PATENT DOCUMENTS

| | | | | |
|---|---|---|---|---|
| 4,606,183 | A * | 8/1986 | Riggs | D07B 1/162 57/7 |
| 6,563,054 | B1 * | 5/2003 | Damien | D07B 1/165 174/121 R |
| 6,692,829 | B2 * | 2/2004 | Stubler | D07B 7/145 428/378 |
| 7,770,328 | B2 * | 8/2010 | Vanderbeken | D07B 1/16 49/352 |
| 8,402,731 | B2 * | 3/2013 | Naito | D07B 5/006 57/210 |
| 8,418,433 | B2 * | 4/2013 | Noguchi | D07B 1/165 57/237 |
| 8,789,658 | B2 * | 7/2014 | Goser | B66B 7/062 474/260 |
| 9,731,938 | B2 * | 8/2017 | Wesson | B66B 7/062 |
| 9,902,212 | B2 * | 2/2018 | Bucher | D02G 3/36 |
| 2002/0189227 | A1 * | 12/2002 | Roux | D07B 7/145 57/7 |
| 2005/0034375 | A1 * | 2/2005 | Vanderbeken | F16C 1/20 49/507 |
| 2006/0174604 | A1 | 8/2006 | Vanderbeken et al. | |
| 2008/0296544 | A1 | 12/2008 | Wesson et al. | |
| 2015/0144245 | A1 * | 5/2015 | Bucher | D02G 3/36 57/216 |
| 2019/0352152 | A1 * | 11/2019 | Sessions | B29D 29/00 |
| 2021/0284501 | A1 * | 9/2021 | Kodeck | D07B 1/162 |
| 2021/0380371 | A1 * | 12/2021 | De Roose | B66B 7/062 |

FOREIGN PATENT DOCUMENTS

| | | |
|---|---|---|
| WO | 2004/076327 | 9/2004 |
| WO | 2013/182599 | 12/2013 |
| WO | 2015/165777 | 11/2015 |
| WO | 2016/096395 | 6/2016 |

OTHER PUBLICATIONS

Somdee et al., "Thermal analysis of polyurethane elastomers matrix with different chain extender contents for thermal conductive application", Journal of Thermal Analysis and Calorimetry, 2019, vol. 138, pp. 1003-1010.
Sardanopoli, A. A., Thermoplastic Polyurethanes (TPUR):, ASM International, Nov. 1988, 3 pages.
Szycher, M., PhD., "Szycher's Handbook of Polyurethanes", CRC Press, 1999, p. 3-5.
Communication of notice of opposition in EP3487802 dated Jun. 4, 2021.
International Search Report dated Sep. 12, 2017 in International Application No. PCT/EP2017/066955.
Written Opinion of the International Searching Authority dated Sep. 12, 2017 in International Application No. PCT/EP2017/066955.
Communication dated Aug. 8, 2022 in corresponding European Patent No. 3487802 (App. No. 17736672.1).
John A. Hiltz, "Characterization of Poly(Ether)urethane Thermoplastic Elastomers", National Defense, Research and Development Branch, pp. 1-30, Aug. 1998.
Nikolaus Mirtschin et al., "Designing temperature-memory effects in semicrystalline polyurethane", RSC Advances, Journal of Royal Society of Chemistry, vol. 5, pp. 46307-46315, May 15, 2015.

* cited by examiner

ELEVATOR TENSION MEMBER WITH A HARD THERMOPLASTIC POLYURETHANE ELASTOMER JACKET

TECHNICAL FIELD

The invention relates to a polymer coated elevator tension member that carries the load of the cabin and the counterweight in an elevator. The elevator tension member is particularly suited for use in an elevator without machine room. Within the context of this application a tension member can be a single steel cord embedded in a polymer jacket, or multiple steel cords arranged parallel to one another in a single plane embedded in a polymer jacket.

BACKGROUND ART

High tensile, fine steel filaments (for example: filaments with a diameter of less than 0.30 mm and a tensile strength in excess of 2000 N/mm$^2$) that are assembled into steel cords are increasingly being used in elevator tension members for a variety of reasons:

- As the filaments are fine, the bending stresses induced on the filaments by a pulley or sheave are smaller than in prior art steel ropes with thick wires;
- Moreover—as the filaments have a high tensile strength—the maximum induced bending stresses may be larger without affecting the fatigue life of the steel cords.
- As the filaments are thin and have a high tensile strength, the breaking load requirement of an elevator tension member can be met in a smaller steel cord diameter. While in prior art elevator ropes a diameter of 8 mm was needed in order to reach the required breaking load, the same breaking load can now be reached with a tension member of only 5 mm or thinner.

Hence, fine, high tensile filaments allow the use of smaller diverting pulleys and drive sheaves in the elevator. Additionally the 'golden rule' in that the diameter of a sheave or pulley had to be larger than 40 times the diameter of the steel rope has been abandoned and currently safe and certified installations are in operation wherein the diameter of the drive sheave is 30 times the tension member thickness while even 25 times the rope diameter is being contemplated.

The use of smaller drive pulleys allows for the use of compact, low torque motors without gearbox that can be mounted in the top of the shaft of an elevator. A machine room on top of the elevator shaft can thereby be eliminated.

The use of high tensile, thin filaments brings also some problems:

- As the total diameter of the steel cord diminishes as well as the diameter of the drive sheave the pressure between the steel cord and the sheave will increase inversely proportional to the product of sheave diameter and steel cord (keeping the conditions of loading identical);
- Fine, high tensile filaments are more sensitive to transversal stresses in the filament than thick, low tensile wires. In addition at contact points between filaments in the rope contact stresses increase compared to the thick prior art wires due to the low diameter of the filament;
- Prior-art elevator ropes have direct steel to steel contact between the sheave and the steel wires. As the fine, high tensile steel filaments also have a higher hardness the wear between sheave and steel rope completely changes;
- Friction behaviour between fine, high tensile steel wire ropes and sheaves is different (lower) as the hardness of sheave and steel wires are different and the contact surface area between rope and sheave is much less compared to prior art steel ropes with thick, low tensile wires;

The above problems can be solved to a large extent by encasing the steel cord or cords in a polymer jacket. The presence of a polymer jacket results in different friction behaviour between the elevator tension member and sheave. Furthermore, the polymer jacket cushions and distributes the pressure on the steel cords at the drive sheave. Additionally, provided the polymer enters the steel cords sufficiently, inter-filament transversal stresses can be alleviated. As a shear stress is induced in the polymer squeezed between the steel cords or cord and the drive sheave during acceleration and deceleration of the elevator, a good adhesion between the polymer and the steel cords is crucial. The polymer jacket therefore becomes a part of the tension member that has an influence on many use parameters of the tension member.

It follows that the material properties of the polymer determine many of the properties of the tension member. While in prior art ropes polymer materials like polyamide, polyethylene, polyethylene terephthalate, and many others have been tried, it appears that thermoplastic polyurethane elastomers are best suited for this application, particularly for their resistance to wear, moisture and heat.

EP 2508459 B1 illustrates the point that the polymer of the jacket has a serious influence on the friction behaviour of the tension member. The preferred polymer is characterised in that it comprises a first and second resin compound at a mass ratio of between 90:10 to 70:30 wherein the difference in glass transition temperature between first and second resin is 20° C. of more. The disclosure mentions that the hardness of the polymer should not be too high as otherwise the tension member—in this case a rope—cannot longer be bent repeatedly (paragraph [0066]). Shore A values of 95 to 100 are too high according to this disclosure.

In U.S. Pat. No. 8,402,731 B2 the polymer should have a Shore A hardness of less than 98, preferably between 85 and 98. In this disclosure, the polymer is a mixture of a polyurethane elastomer and an isocyanate compound having two or more isocyanate groups per molecule. The inventors revealed that when the hardness of the polymer jacket becomes too high—larger than Shore A 98—the flexibility of the rope is impaired resulting in an increase in power consumption of the elevator.

The sizes of the steel cords considered in all these applications are larger than 8 mm.

The inventors found that the jacket polymer of the elevator tension member also has a profound, hitherto unsuspected influence on the fatigue life of the elevator tension members as will be disclosed in the subsequent sections.

DISCLOSURE OF INVENTION

It is an object of the invention to provide for an elevator tension member that has remarkable fatigue properties. These improved fatigue properties solely derive from the polymer properties of the polymer jacket. More in particular the improved fatigue properties correlate with specific thermal properties of the thermoplastic polyurethane elastomer used. The work of the inventors allows selecting those thermoplastic polyurethane elastomers that favourably influence the fatigue properties solely on the basis of the thermal properties of the polyurethane thereby offering a simple method for selecting such compounds. This selection method can be used for designing and producing an elevator tension member.

According a first aspect of the invention an elevator tension member is provided comprising all features of claim 1.

The elevator tension member comprises one or more steel cords and a jacket encasing the steel cords. The jacket comprises a thermoplastic polyurethane elastomer. For the sake of brevity in what follows whenever the abbreviation TPE is mentioned it should be replaced with 'thermoplastic polyurethane elastomer'. The TPE has a hard crystalline phase and a soft phase. Characteristic of the particul TPE used is that it has a glass transition temperature of the hard crystalline phase that is higher than 90° C. In a restricted version the elevator tension member consists of one or more steel cords and a jacket encasing the steel cords.

The jacket may optionally consist solely of thermoplastic polyurethane elastomer.

These features are now clarified in more detail:

When there is only one steel cord present, the steel cord is situated central in the cross section of the elevator tension member. The cross section of the elevator tension member can have any polygonal shape such as square or hexagonal, although a round cross section is most preferred as this allows the tension member to rotate in the pulleys of the elevator installation. Such an elevator tension member is recognised as 'an elevator rope'.

When more steel cords are present such as two, three or more up to twelve or twenty four these steel cords are arranged in a side by side relationship in a single plane. By preference the number of steel cords is even and there are as many steel cords that have a left turning lay—called 'S' lay—as there are steel cords with a right turning lay—called 'Z' lay.

Even more preferred is if the lay direction alters between neighbouring steel cords. The arrangement of the steel cords results in an elevator tension member that has a cross section with a width and a height, the width being substantially larger than the height. Such tension member is generally known as an 'elevator belt'.

The steel cords comprise—and in examples may consist solely of—high tensile fine steel filaments. These high tensile fine steel filaments are derived from high carbon steel wire rods with a composition having a minimum carbon content of 0.65%, a manganese content ranging from 0.40% to 0.70%, a silicon content ranging from 0.15% to 0.30%, a maximum sulphur content of 0.03%, a maximum phosphorus content of 0.30%, all percentages being percentages by weight. There are only traces of copper, nickel and/or chromium in the steel. When using higher carbon contents of around 0.80 weight %, e.g. 0.78-0.82 weight % even higher tensile strengths can be obtained.

The steel filaments are assembled into steel cords in the manners known per sé. Particularly preferred are multi-strand cords wherein steel filaments are first assembled into strands. Subsequently the strands are twisted into a steel cord. Examples of such assemblies are 7×7 cords comprising one core strand around which six outer strands are wound. The core strand is made up of a king wire surrounded by six filaments, each of the outer strands likewise made up of a central wire around which six filaments are wound. Another example is 19+8×7 wherein the core strand is made up of one king wire surrounded by six intermediate layer filaments wound at a first lay length around which twelve outer layer filaments are twisted in a second layer with a second lay length. The core strand is surrounded by 8 strands of the type "1+6" i.e. one central wire around which six outer filaments are wound. These two types are particularly applicable for belt type tension members.

For elevator rope type tension members the core strand is replaced by a core rope for example a 7×7 core rope. Around the core rope six to twelve outer strands are wound. The outer strands preferably contain at least 19 filaments in order to have enough strength at low diameter and to ensure that the overall cord remains flexible. A particular advantageous assembly of 16, 19 or 22 wires are Warrington strands that are of type '$d_0+5\times d_1|5\times d_2/5\times d_3$' or '$d_0+6\times d_1|6\times d_2/6\times d_3$' or '$d_0+7\times d_1|7\times d_2/7\times d_3$'. In a Warrington type strand all filaments are twisted into the strand with the same lay length. In for example the '$d_0+6\times d_1|6|\times d_2/6\times d_3$' strand the core filament of diameter do is surrounded by a first layer of six filaments of diameter $d_1$. In the outbound recesses of the first layer, six outer filaments are positioned of diameter '$d_2$' larger than '$d_1$'. In between these outer filaments smaller sized filaments of diameter '$d_3$' fit so that the outer circumscribed circle touches all outer 12 filaments. Warrington strands are particularly preferred in that they contain a large number of fine filaments that are in line contact with one another. Line contacts are preferred as they result in less transversal pressure in the fine high tensile wires. Other strand constructions like Seale constructions can also be envisioned. Seale constructions are of type '$d_0+N\times d_1|N\times d_2$ wherein N is five, six, seven, eight or nine. Like a Warrington all filaments are twisted together with a single lay. In a Seale construction the filaments with diameter '$d_2$' of the second layer are thicker than the intermediate layer filaments $d_1$ in as much they completely close the outer layer.

The one or more steel cords are encased in a jacket i.e. the jacket completely contains, covers, or encircles all the steel cords of the tension member. The purpose of the jacket is:

- To transfer acceleration and deceleration forces between the steel cords and the drive sheave;
- To spread the pressure over all steel cords within the tension member or over all strands within the steel cords evenly;
- To provide sufficient friction between the drive pulley and the tension member in order to drive the elevator;
- The jacket also serves to keep the steel cords in parallel arrangement to one another in the case of an elevator belt. In the case of an elevator rope, the jacket also keeps the outer strands in position provided the jacket is also present in between the strands.

TPE's are reaction products of three basic components:

- Hydroxyl terminated polyester or polyether high molecular weight (600 to 4000 Da) diols or mixtures thereof. Examples of polyethers are poly(oxypropylene) diols and poly(oxytetramethylene) diols. Examples of polyesters are adipates, polycaprolactones, and aliphatic polycarbonates.
- a chain extender: this is a low molecular weight (61 to 400 Da) diol such as ethylene glycol, 1,4-butanediol, 1,6-hexanediol or hydroquinone bis (2-hydroxyethyl) and;
- a bulky polyisocyanate mostly a diisocyanate. The most popular one being diphenylmethane-4,4-diisocyanate (MDI). Others are hexamethylene diisocyanate (HDI) or 3,3'-dimethyl-4,4'-biphenyl diisocyante (TODI).

The examples of chemicals are not limiting to the invention.

When solidified TPE's show different material phases intermixed:

- There are the hard segments ("HS") that are formed by the reaction of the diisocyanate with the chain extender. These hard segments form a crystalline phase;

The hard segments are held to one another through the soft segments ("SS") formed by the high molecular weight polyether or polyester chains that connect to the one of the cyanate ends of the diisocyanate. The soft segments form the 'soft phase'.

The properties of TPE's can be tuned by a proper choice of the three components. The proportion of hard segments (formed by the diisocyanate and the short chain diol) is the factor determining the majority of properties of the resulting material such as hardness, modulus, tear strength, and upper use temperature. If the hard segment content increases, the hardness, along with modulus, load bearing capacity (compressive stress), tear strength will also increase. The proportion of soft segments determines the elastic and low-temperature properties.

The number of different TPE grades offered in the market makes the choice of the proper grade for use in an elevator tension member an arduous task. In particular because in an elevator tension member different properties have to be reconciled such friction of the jacket to the drive sheave, wear resistance, fatigue, temperature resistance etc. . . . .

Much to their surprise the inventors found that the jacket has a large influence on the fatigue life of the elevator tension member as a whole. While normally it is expected that the fatigue life of the elevator tension member is determined by its strongest component namely the one or more steel cords, certain types of TPE turned out to have a strong non-linear effect on that fatigue life.

After careful analysis of the many grades of TPE tested, the inventors found that those TPE's with a glass transition temperature of the hard crystalline phase above 90° C. resulted in better than standard fatigue life of the elevator tension member. Even better is if the glass transition temperature of the hard crystalline phase is above 100° C. For the avoidance of doubt: '° C.' refers to 'degrees Celsius'.

For the purpose of this application a glass transition temperature '$T_g$' is that temperature obtained by Differential Scanning Calorimetry (DSC) wherein upon heating an endothermic valley or step is noticed that is representative for the dissociation of the soft segments and the hard phase at the temperature $T_g$. The cooling-heating rate is set to 20° C./min.

TPE's generally exhibit two glass transitions upon heating: one at a low temperature wherein the soft segments melt in between the hard segments at $T_{g\ SS}$ and one at a higher temperature $T_{g\ HS}$ at which also the hard segments start to lose their coherence. For the TPEs of interest the $T_{g\ SS}$ of the soft segments is always below 0° C. $T_{g\ SS}$ has been found to be less relevant for the selection of the polymers of interest.

TPE's also exhibit a crystallisation temperature. When heating TPEs sufficiently also the hard phase like the soft segments will turn into a liquid. Upon cooling, they will first solidify from the melt into an amorphous solid that will further undergo glass transitions at $T_{g\ HS}$ and at even lower temperature will completely crystalize below $T_{g\ SS}$. The exothermic peak of crystallisation is well recognisable at the crystallisation temperature $T_c$. The crystallisation peak is always determined during cooling from the melt for example at a rate of 20° C./min.

In a further preferred selection of TPE's the crystallisation temperature $T_c$ is at least 20° C. higher, or even 25° C. or 30° C. higher than the glass transition temperature of the hard crystalline phase $T_{g\ HS}$. It is likewise preferred that the crystallisation temperature is less than 80° C. above the glass transition temperature of the hard crystalline phase. When the crystallisation temperature becomes too high the TPE becomes extremely difficult to process.

An independent selection of TPE's can be made on the criterion that the sum of the crystallisation temperature $T_c$ and of the glass transition temperature of said hard crystalline segment $T_{g\ HS}$ is higher than 200° C. or even higher than 210° C. or above 240° C. The higher $T_{g\ HS}$ increases the maximum working temperature while the higher $T_c$ results in better operational properties in the elevator tension member.

These TPEs are in general significantly harder than the TPE's that are presently considered useable in an elevator tension member. The inventors found that the type of TPE's specified above do work well when combined with steel cords having a lower diameter than 8 mm (end point not excluded). From the work of the inventors it appears that they still work well with cords that are thicker than 1 mm. Preferably the diameter range for the steel cords is between 1 and 5 mm, or between 2 and 5 mm, end points included.

When selecting TPEs in line with the above criteria, they turn out to have a hardness that is out of scale or at least at the very high side of Shore A hardness measurements. Their hardness is best assessed on a Shore D hardness scale. On that scale of Shore D hardness of the TPEs is between 40 to 90, preferably 45 to 70 or even better between 50 to 60. These are hardness values that in the prior art would have been considered not useable.

The contribution of the jacket to the bending stiffness of the tension member becomes higher than normal. The bending stiffness '$(EI)_{tm}$' of the tension member (expresses in $Nmm^2$) is the proportionality factor that links the curvature 'k', expressed in 1/mm, taken by the tension member under action of a bending moment '$M_b$', expressed in Nmm. In the case of an elevator belt, the bending stiffness is—for the purpose of this application—only considered in the direction of bending perpendicular to the length×width dimension of the elevator belt. The bending stiffness is determined in a three point bending test. In such a test a piece of tension member is supported without friction at the two ends. While the test piece is deflected in the middle by means of an impeller the force exerted on this impeller is measured. Out of the deflection-force diagram the bending stiffness '$(EI)_{tm}$' can be determined by conventional bending theory formula. The result includes thus the stiffness attributable to the steel cord or steel cords and the jacket.

Likewise one can measure the bending stiffness on the bare steel cord only: '$(EI)_{sc}$'. With the 'bare steel cord' is meant the steel cord prior to being embedded into the jacket. In case there are more than one steel cord the bending stiffness of the individual steel cords simply add up. In this way a fraction of the total stiffness that is attributable to the steel cords only can be determined. This amounts to $100\times((EI)_{sc}/(EI)_{tm})$ when expressed in percent. The inventors have found that the tension members that perform best in fatigue tests are those of which the contribution of the steel cords is below 20%, preferably between 10 and 20% (limit values included). This means that the majority of the bending stiffness—more than 80%—of the tension member can be attributed to the polymer jacket.

Worded alternatively: the bending stiffness of the elevator tension member is at least five times the total bending stiffness of the bare one or more steel cords. This is much more than is customary in the field.

The contribution to the stiffness of the jacket of course also depends on the geometry of the cross section of the tension members: as the jacket is situated furthest away from the neutral plane of bending, its contribution will be higher than the steel cords that are closer to the neutral plane. Also when the polymer jacket becomes thicker also then the contribution to the bending stiffness of the jacket will rise. The inventors have found that the required contribution of the jacket to the total bending stiffness can be obtained when the thickness of the jacket is at least 8% of the largest diameter of the one or more steel cords. With 'thickness of the jacket' is meant the minimum of distances between any one of said one or more steel cords and the outer surface of said tension member.

On the other hand, the thickness of the polymer should not be more than 80% of the largest diameter of the one or more steel cords as then the outer surface of the polymer jacket is stretched too far when being bent. This may lead to premature cracking of the polymer. More preferred is if the thickness of the polymer is between 10% to 60% of the largest diameter of the one or more steel cords.

Another factor that greatly influences the contribution of the jacket to the overall stiffness of the tension member is to what degree the TPE has ingressed the one or more steel cords during manufacturing. In a cross section perpendicular to the tension member one can easily discriminate as to where the TPE is present in the tension member. When considering a steel cord, it can be circumscribed by a circle of minimum radius. Inside the circumscribed circle part of the area will be occupied by steel and the remaining part will be free of steel. The 'available area' inside the circumscribed circle of the steel cord is the area that is free of steel. At least 80% of that available area must be occupied by the TPE. Of course the 'available area' in cross section can be translated to an 'available space or volume' inside the circumscribed cylinder as the cross sectional area does not change over the length of the steel cord. If less of the available area is taken by the TPE, the tension member will not have the benefits of a composite: the jacket may act independently of the steel cord and may even loose hold to the steel cord(s). The penetration of the TPE into the steel cord ensures sufficient mechanical anchorage between steel and jacket during use. This is important as all force is transmitted form the steel cord to drive pulley through the jacket.

In the case of the tension member comprising one single steel cord, i.e. an elevator rope, the range of thickness of the polymer jacket is preferably between 8% and 20% of the diameter of the steel cord. In this case the tension member has a substantially circular cross section. With 'substantially circular' is meant that the deviation between the minimum and maximum calliper diameter is less than 10% of the average of minimum and maximum calliper diameter or preferably less than 5% of that average. The calliper diameter is the diameter measured by means of a calliper having parallel jaws wherein in between the diameter of the elevator rope is measured at touch.

In the case of the tension member comprising one steel cord, the bending stiffness of the bare one steel cords is between 8 and 17 $kNmm^2$. The bending stiffness of the tension member is then respectively at least 40 $kNmm^2$ to at least 85 $kNmm^2$.

In the case of the tension member comprising one or more steel cords the cooperation of the one or more steel cords with the TPE jacket can be further improved by the application of an adhesion primer. Suitable adhesion primers to improve the chemical bond between the steel cord and the TPE are for example organo functional silanes, organo functional titanates and organo functional zirconates which are known in the art for said purpose. The advantage of using these primers—in contrast to other known adhesion primers—is that they form a nanoscale film (less than 5 nanometer thin) on the one or more steel cords. Thereby they do not jeopardise the ingress of TPE into to the steel cord.

Preferably, but not exclusively, the organo functional silane primers are selected from the compounds of the following formula:

$$Y—(CH2)_n\text{-}SiX_3$$

wherein:

Y represents an organo functional group selected from —NH2, CH2=CH—, CH2=C(CH3)COO—, 2,3-epoxypropoxy, HS— and, Cl—

X represents a silicon functional group selected from —OR, —OC(=O)R', —Cl wherein R and R' are independently selected from C1 to C4 alkyl, preferably —CH3, and —C2H5; and n is an integer between 0 and 10, preferably from 0 to 10 and most preferably from 0 to 3. The organo functional silanes described above are commercially available products.

The adhesion primer must enable a shear stress that is higher than 4 $N/mm^2$. The shear stress is measured over a length of 10 mm.

In the case of a single steel cord, the jacket is cut at a distance of 10 mm from the end of the tension member. The maximum force needed to pull off the jacket is determined and divided by the inner surface area of the jacket i.e. $\pi D \times L$, wherein D is the diameter of the steel cord in mm and L is 10 mm. An average of three values is taken;

In the case more than one steel cords are present in the tension member as in an elevator belt a steel cord other than the outer steel cords is singled out of the parallel arranged steel cords. The cords aside of the singled out cord are cut on one line perpendicular to the singled out cord and the singled out cord is cut 10 mm below the line. The maximum force needed to pull out the singled cord is determined and divided by the inner surface area of the jacket.

According a second aspect of the invention a method is presented to select a thermoplastic polyurethane elastomer for use as a jacket encasing one or more steel cords in an elevator tension member. The method comprises the steps of obtaining a number of different TPEs from different suppliers. Then to perform a differential scanning analysis on the series of TPEs thereby determining:

i. Determining the highest glass transition temperature during heating of said TPE which corresponds to the glass transition temperature Tg HS of the hard segments of the TPE;

ii. Determining the crystallisation temperature Tc of the TPE during the cooling from the melt;

Selecting the TPE for use as a jacket for encasing one or more steel cords in an elevator tension member if and only if:

i. The glass transition temperature $T_{g\ HS}$ of the hard segments is larger than 90° C. and;

ii. The sum of the glass transition temperature $T_{g\ HS}$ and the crystallisation temperature $T_c$ is larger than 200° C.

In a further limitation of the method, only those TPE's are considered that, in addition to the previous requirements, have a hardness above 40 Shore D hardness or even above 45 Shore D hardness.

The thus selected TPE can be used in the third aspect of the invention namely a method to produce an elevator tension member comprising the steps of:

Providing one or more steel cords arranged in a single plane;

Selecting the TPE as described in the preceding procedure;

Extrude the selected thermoplastic TPE around the one or more steel cords;

Whereby an elevator tension member according the invention is obtained.

BRIEF DESCRIPTION OF FIGURES IN THE DRAWINGS

Figure 3A:
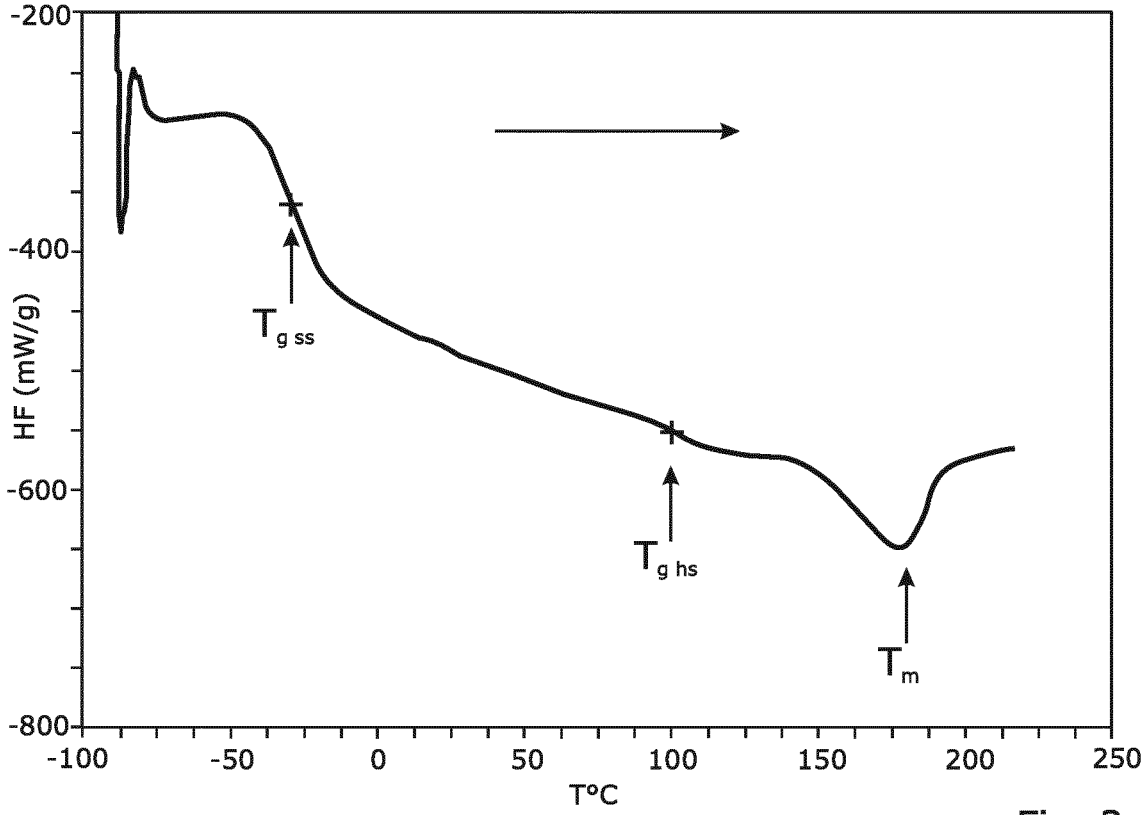
Figure 3B:
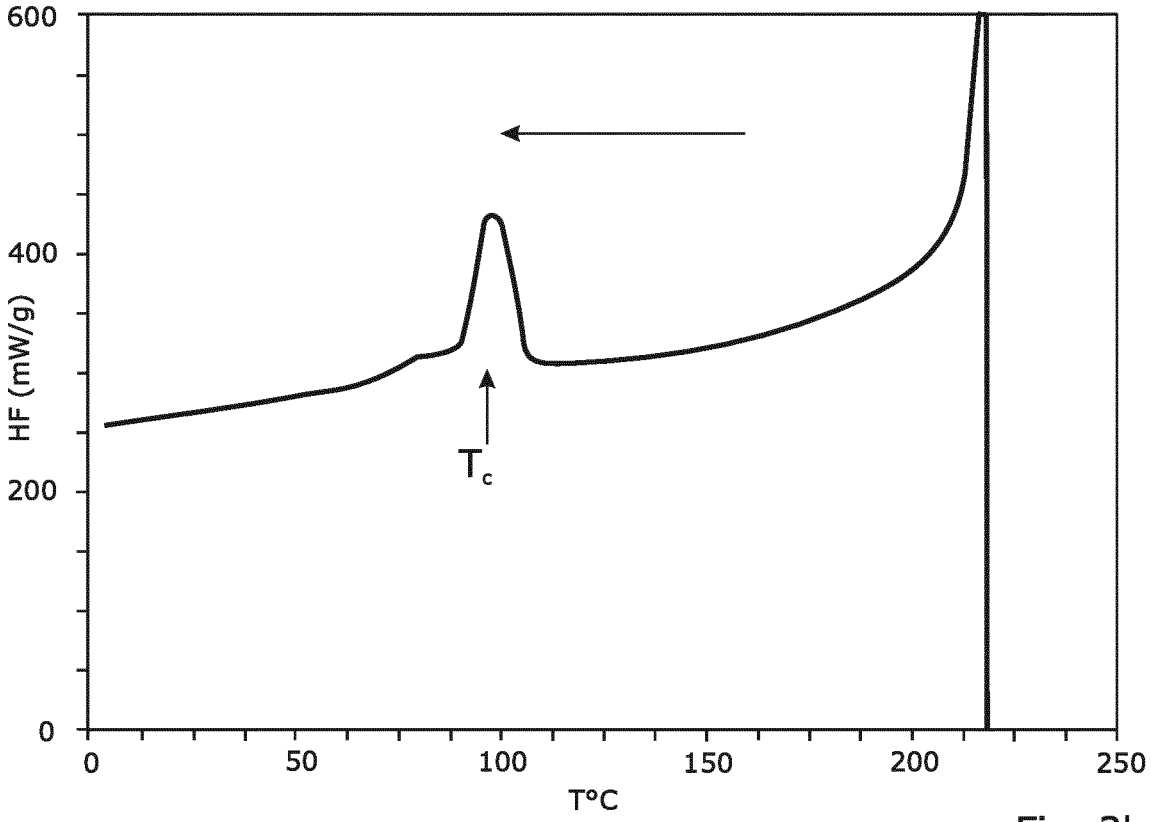

FIGS. 3*a* and 3*b* show schematic Differential Scanning Calorimetry (DSC) curves indicating the thermal features of a TPE.

Figure 4:
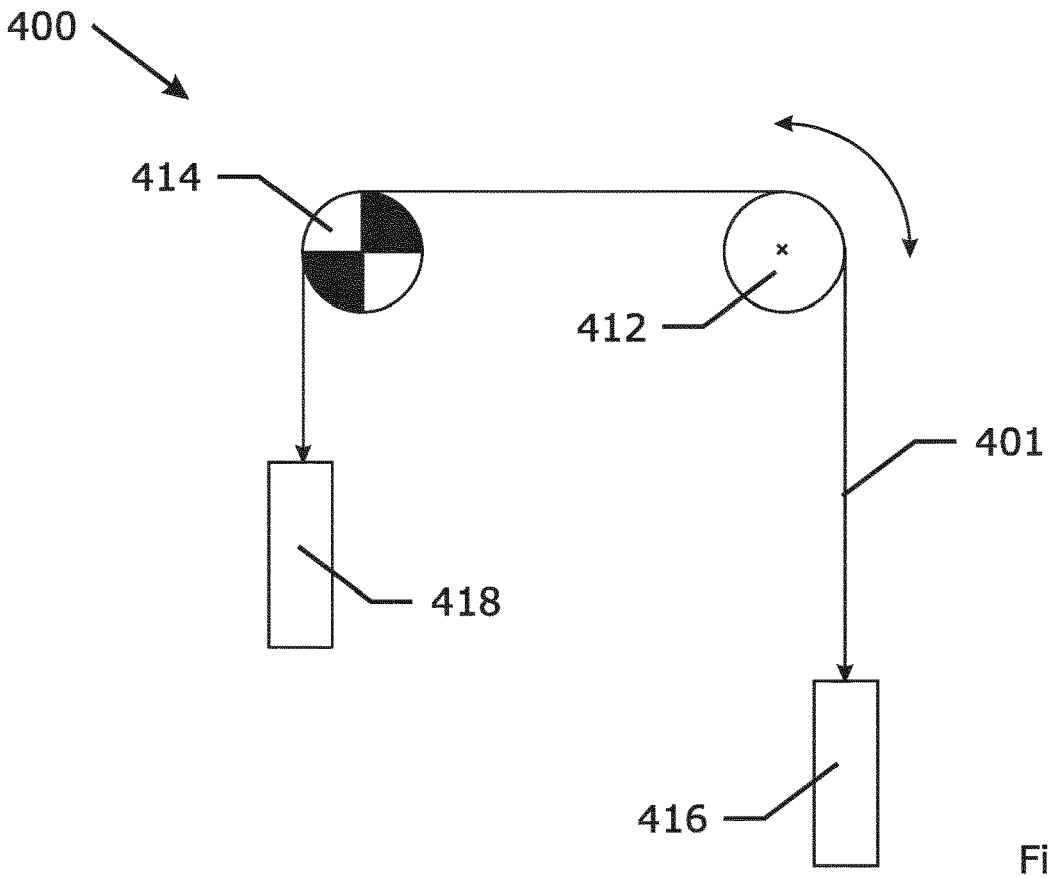

FIG. 4 shows a test system to evaluate the fatigue life of an elevator tension member.

Figure 5:
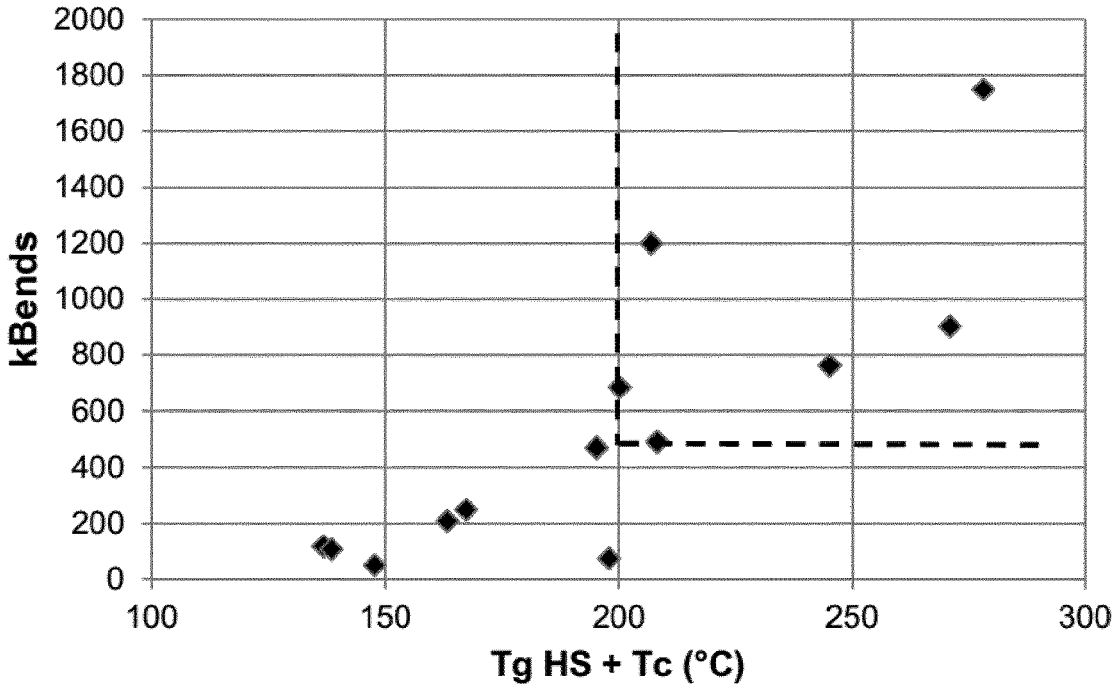

FIG. 5 shows the relation between the number of fatigue cycles obtained on various TPEs in relation to the sum of $T_{g\ HS}+T_c$.

MODE(S) FOR CARRYING OUT THE INVENTION

FIG. 1*a* shows an elevator tension member that is in this case an elevator rope. The rope consists of a steel cord 106 that is surrounded by a polymer jacket 110. The steel cord is of the generic type 7×7+19W that in more detailed form is:

$$\{[(0.34+6\times0.31)+6\times(0.25+6\times0.25)]+7\times(0.34+6\times 0.31|6\times0.33/6\times0.25)\}$$

The numbers indicate the diameters of the filaments in millimetre. The brackets indicate one operation wherein steel filaments are assembled into strands and strands into cord. The core of the steel cord 104 is of the 7×7 type, that has a king strand (0.34+6×0.31) surrounded with 6 strands of make (0.25+6×0.25). Around the 7×7 core 7 strands of the Warrington type are twisted, wherein all filaments are twisted in one single operation. The lay direction between different layers are alternating and have a magnitude between 5 to 12 times the diameter of the strand or cord. The steel cord can be circumscribed with a circle 102 and has a calliper diameter 'D' which is in this case 5.0 mm.

The tension member has a jacket 110 that is extruded around the steel cord 106. The jacket has a substantial circular cross section with a total diameter '$D_{tot}$' of 6.5 mm. The thickness—indicated with 't'—is therefore about 0.75 mm which corresponds to the minimal of distances between the steel cord 106 and the outer surface of the tension member. The polymer fills to a large degree—in this case 85%—the available area inside the circumscribed circle 102.

Figure 2:
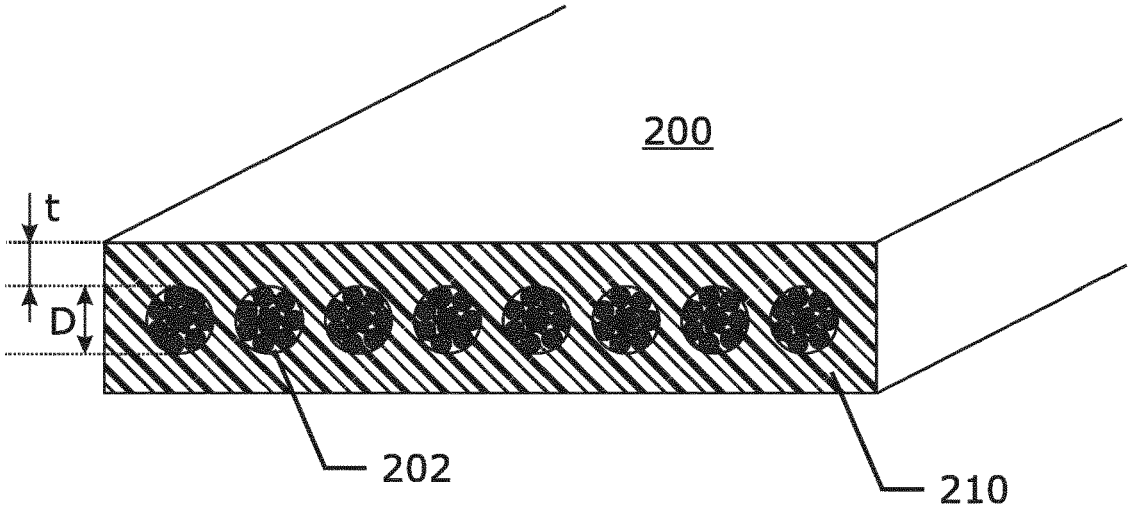
FIG. 2 shows an elevator tension member according the invention with eight steel cords: an elevator belt.

FIG. 2 shows an alternative elevator tension member 200 wherein 8 steel cords 202 are arranged in a side by side relationship in a single plane. Neighbouring steel cords have opposite lay directions. The cords have a 7×7 configuration with formula $$[(0.21+6\times0.19)+6\times(0.19+6\times0.175)]$$

The cords are encased, embedded, surrounded in a polymer jacket 210 consisting of a TPE.

Figure 1:
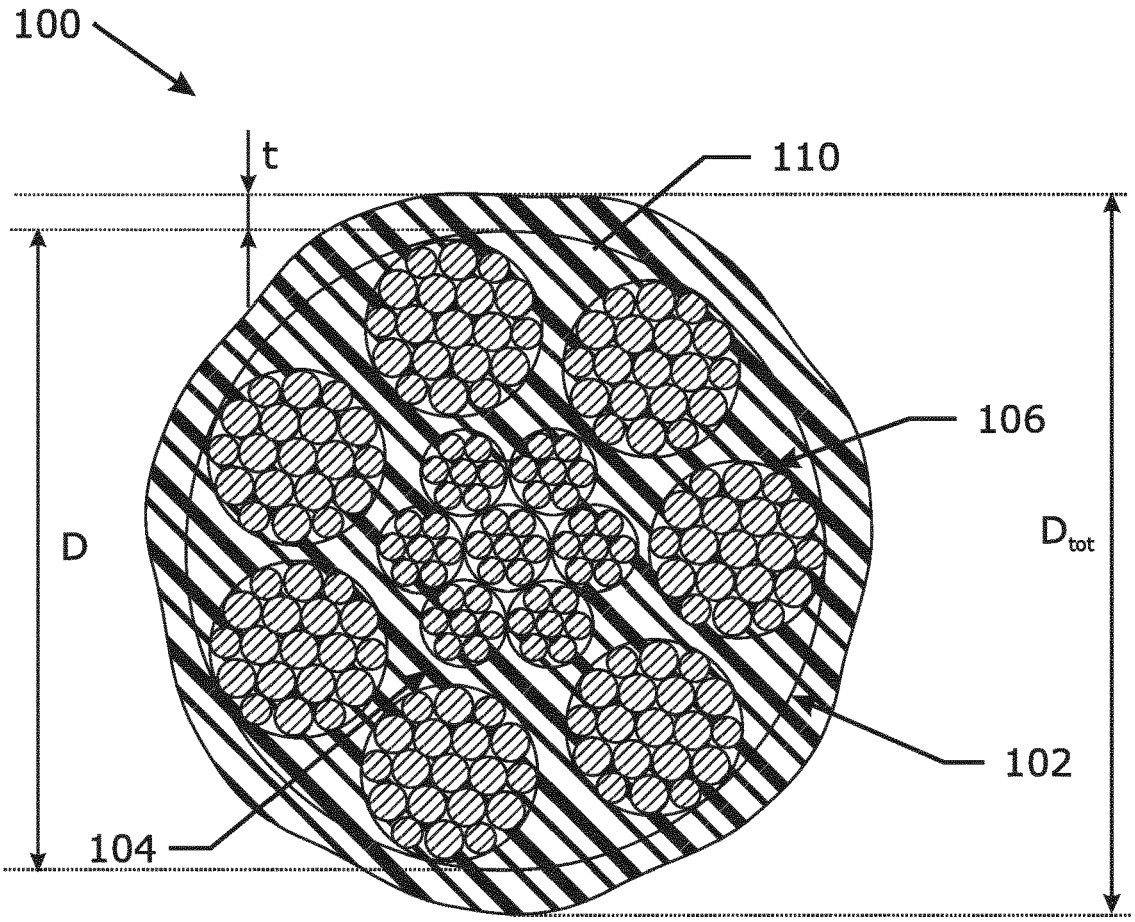
FIG. 1 shows an elevator tension member according the invention with one single steel cord: an elevator rope.

The inventors evaluated a large number of commercially available TPE's as obtainable from known suppliers such as Bayer, BASF, Teknor-Apex, Lubrizol, etc. . . . . The same one steel cord as depicted in FIG. 1 was extruded with all these TPEs.

The thermal properties of the TPEs were determined in a DCS measurement. FIGS. 3*a* and 3*b* describe such a trace of TPE 5 (see further): 3*a* upon second heating, 3*b* during first cooling. In the abscissa the temperature is represented (in ° C.) while in ordinate the heatflow (in mW/g) is represented. The relevant glass transition temperatures of soft segments ($T_{g\ SS}$), hard segments ($T_{g\ HS}$) and melting ($T_m$) temperatures are determined on second heating, after erasing the thermal history of the sample and after all water is evaporated. The skilled lab technician knows how to determine these transition temperatures. Upon cooling (FIG. 3*b*) an exothermic peak is noticed when the sample starts the crystalize at the crystallisation temperature $T_c$. The measurement of these properties is simple and takes less than one hour.

The extruded samples of elevator ropes were tested for fatigue life in a test system such as depicted in FIG. 4. In the test system 400, the elevator tension member 401 is tensioned by two weights 416, 418 to 12% of the breaking load of the elevator rope. The test system 400 comprises one traction sheave 414 driven by an electrical motor and one additional deflection sheave 412. Both sheaves 412, 414 have round grooves with a groove radius slightly larger than the diameter of the tested load bearing assemblies 401. During fatigue testing the motor drives the load bearing assembly 401 back and forth over both traction sheave 412 and the deflection sheave 414. The test system is a good representation of a real life elevator. The diameter '$D_{sheave}$' of both traction sheave 412 and deflection sheave 414 is 16.1 times the total diameter '$D_{tot}$' of the elevator tension member. In the test the ratio '$D_{sheave}/D_{tot}$' is much lower than the conventionally used ratio 40.

The ratio $D/D_{tot}$ was intentionally chosen low to test the elevator tension member in extreme conditions. The test is continued till the jacket of the elevator tension member cracks or shears off. For a single cord this can take between 50 000 to 2 000 000 bends. As one bend takes about one second the duration of one test is between ½ and 24 days. There is therefore a large benefit if one can reduce the selection of the TPE by performing a simple DCS test. Based on this test, the number of candidate TPEs can already be largely reduced before having to resort to elaborated fatigue testing of the elevator tension member in its entirety.

In Table 1 an overview of the samples tested is shown: Column (1) identifies the TPE type, the second column (2) is the glass transition temperature of the hard segments ($T_{g\ HS}$ (° C.)), column (3) is the melting temperature of the TPE, column (4) is the crystallisation temperature $T_c$ (° C.), column (5) is the difference of the crystallisation temperature and the glass transition temperature of the hard segments ($T_c-T_{g\ HS}$ (° C.)), followed by the sum of both (($T_c+T_{g\ HS}$ (° C.)), column (6)). Column (7) lists the Shore D hardness values. Column (8) lists the number of bends (per 1000 bends or kBends) attained with each cord. The last column (9) is the measured bending stiffness on the elevator tension member (in $Nmm^2$).

TPE 1 to 7 and TPE 12 all have a hard segment glass transition temperature above 90° C. (indicated bold). Of those TPE 1, 3, 4, and 7 have a crystallisation temperature that is at least 20° C. above the hard segments glass transition temperature (indicated bold underlined).

From another perspective, the TPEs 1, 2, 3, 4, 7 and 12 have the sum of the hard segment glass transition and the crystallisation temperature above 200° C. (indicated bold double underlined).

Table 1 proves the assertion of the inventors that in order to obtain more than 490 000 bends in the test system a TPE with a hard segment glass transition temperature that is larger than 90° is needed. Even longer fatigue life can be obtained when the crystallisation temperature is at least 20° C. higher than the hard segment glass transition temperature.

There appears also a trend that the fatigue life increases with the sum of the hard segment glass transition temperature and the crystallisation temperature. This is graphically represented in FIG. 5. There the number of bending cycles (kBends) attained is plotted as a function of the sum of the hard segment glass transition ($T_{g_HS}$) temperature and the crystallisation temperature ($T_c$). The vertical dashed line indicate the 200° C. limit, while the horizontal dashed line indicates the 490 000 bends limit line.

Next to that the bending stiffness of the elevator tension member was determined. To this end a specimen of the elevator tension member is supported horizontally between two frictionless fulcrums 50 times the diameter of the steel cord (5.00 mm for this steel cord) apart. The wire is deflected at the middle with a roll indenter. The force exerted on and the displacement of the indenter are recorded. Out of classical bending theory the bending stiffness can be derived from:

$$(EI)_{SC} = \frac{L^3 \cdot \Delta F}{48 \cdot \Delta X}$$

Wherein L is the distance between the support fulcrums, ΔF, ΔX indicated the change in force and the change in displacement in the upper linear region of the curve.

For the bare steel cord i.e. the steel cord used prior to extrusion the bending stiffness measured was 14 000 $Nmm^2$. The elevator ropes that attain the best fatigue results have a bending stiffness that is at least 5 times the bending stiffness of the bare cord.

It is remarkable that fatigue results increase so drastically in function of the TPEs used, while the steel cord remains exactly the same. The selection of TPEs is by the invention much easier and only relies on a simple DCS measurement.

| (1) Nr | (2) Tg HS (° C.) | (3) Tm (° C.) | (4) Tc (° C.) | (5) Tc-Tg (° C.) | (6) Tc +Tg HS (° C.) | (7) Shore D | (8) kBends | (9) El ($Nmm^2$) |
|---|---|---|---|---|---|---|---|---|
| TPE 1 | 90 | 179 | 111 | 21 | 201 | 46 | 686 | 80513 |
| TPE 2 | 99 | 155 | 110 | 11 | 208 | | 491 | |
| TPE 3 | 105 | 186 | 173 | 69 | 278 | 52 | 1749 | 101807 |
| TPE 4 | 108 | 180 | 163 | 55 | 271 | 42 | 904 | 88021 |
| TPE 5 | 100 | 179 | 98 | −2 | 198 | | 75 | 31892 |
| TPE 6 | 104 | 162 | 92 | −12 | 195 | 40 | 470 | 94712 |
| TPE 7 | 92 | 180 | 153 | 60 | 245 | | 763 | 85795 |
| TPE 8 | 63 | 173 | 104 | 42 | 167 | | 250 | |
| TPE 9 | 60 | 129 | 88 | 28 | 148 | | 50 | 48034 |
| TPE 10 | 50 | 118 | 87 | 37 | 137 | | 118 | 46346 |
| TPE 11 | 60 | 175 | 103 | 43 | 163 | 42 | 208 | 63969 |
| TPE 12 | 100 | 180 | 107 | 7 | 207 | 50 | 1201 | |
| TPE 13 | 25 | 160 | 114 | 89 | 138 | 54 | 108 | |

The invention claimed is:

1. An elevator tension member comprising one or more steel cords and a jacket encasing said steel cords, wherein said jacket comprises a thermoplastic polyurethane elastomer, said thermoplastic polyurethane elastomer having a hard crystalline phase and a soft phase, wherein the glass transition temperature of said hard crystalline phase is higher than 90° C., wherein said thermoplastic polyurethane elastomer further has a crystallisation temperature, said crystallisation temperature being measured during cooling from the melt and wherein the sum of said glass transition temperature of said hard crystalline phase and said crystallisation temperature is higher than 200° C.

2. The elevator tension member according to claim 1, wherein the diameter of each of said steel cords is lower than or equal to 8 mm and larger than or equal to 1 mm.

3. The elevator tension member according to claim 1, wherein the Shore D hardness of said thermoplastic polyurethane elastomer is between 40 and 90.

4. The elevator tension member according to claim 3, wherein the Shore D hardness of said thermoplastic polyurethane elastomer is between 45 and 60.

5. The elevator tension member according to claim 1, wherein the bending stiffness of the elevator tension member is at least five times the total bending stiffness of the one or more steel cord.

6. The elevator tension member according to claim 1, wherein the thickness of said jacket is at least 8% of the maximum diameter of said one or more steel cords said thickness being the minimum of distances between any of said one or more steel cords and the outer surface of said tension member.

7. The elevator tension member according to claim 1, wherein said thermoplastic polyurethane elastomer occupies at least 80% of the available area inside the circumscribed circle of any one of said one or more steel cords in a perpendicular cross section.

8. The elevator tension member according to claim 1, wherein one steel cord is encased in said jacket, said tension member having a substantially circular cross section and wherein the thickness of said jacket is thinner than 20% of the diameter of the tension member, said thickness being the minimum of distances between said one steel cord and the outer surface of said tension member.

9. The elevator tension member according to claim 8, wherein the bending stiffness of the bare one steel cord is between 8 and 17 $kNmm^2$.

10. An elevator tension member comprising one or more steel cords and a jacket encasing said steel cords, wherein said jacket comprises a thermoplastic polyurethane elastomer, said thermoplastic polyurethane elastomer having a hard crystalline phase and a soft phase, wherein the glass transition temperature of said hard crystalline phase is higher than 90° C., wherein said thermoplastic polyurethane elastomer further has a crystallisation temperature that is at least 20° C. higher than glass transition temperature of said hard crystalline phase, said crystallisation temperature being measured during cooling from the melt.

11. The elevator tension member according to claim 10, wherein said crystallisation temperature is less than 80° higher than the glass transition temperature of said hard crystalline phase.

12. An elevator tension member comprising one or more steel cords and a jacket encasing said steel cords, wherein said jacket comprises a thermoplastic polyurethane elastomer, said thermoplastic polyurethane elastomer having a hard crystalline phase and a soft phase, wherein the glass transition temperature of said hard crystalline phase is higher than 90° C., wherein said one or more steel cords is treated with an adhesion primer to improve the adhesion between said one or more steel cords and said jacket such that the shear stress needed to pull a 10 mm long embedded steel cord out of said jacket is higher than 4 $N/mm^2$.

13. A method of selecting a thermoplastic polyurethane elastomer for use as a jacket encasing one or more steel cords in an elevator tension member, said method comprising the steps of:

obtaining a thermoplastic polyurethane elastomer in a differential scanning analysis performed on said thermoplastic polyurethane elastomer:

i. determining the highest glass transition temperature during heating of said polyurethane, said glass transition temperature corresponding to the glass transition temperature of the hard segments in said polyurethane;

ii. determining the crystallisation temperature of said polyurethane during the cooling of the melt;

selecting the thermoplastic polyurethane elastomer for use as a jacket for encasing one or more steel cords in an elevator tension member if and only if:

i. said glass transition temperature of the hard segments is higher than 90° C. and;

ii. the sum of said glass transition temperature and said crystallisation temperature is larger than 200° C.

14. A method to produce an elevator tension member comprising the steps of:

providing one or more steel cords arranged in a single plane;

selecting a thermoplastic polyurethane elastomer according the method of claim 13;

extruding the selected thermoplastic polyurethane elastomer around said one or more steel cords;

thereby obtaining an elevator tension member.

* * * * *